US011149454B1

(12) United States Patent
Andrews et al.

(10) Patent No.: US 11,149,454 B1
(45) Date of Patent: Oct. 19, 2021

(54) FLEXIBLE NET DOME FOR OUTDOOR POOLS

(71) Applicants: John J. Andrews, Starbuck, WA (US); Sandra Conklin, Starbuck, WA (US)

(72) Inventors: John J. Andrews, Starbuck, WA (US); Sandra Conklin, Starbuck, WA (US)

( * ) Notice: Subject to any disclaimer, the term of this patent is extended or adjusted under 35 U.S.C. 154(b) by 0 days.

(21) Appl. No.: 16/949,530

(22) Filed: Nov. 2, 2020

(51) Int. Cl.
*E04H 4/10* (2006.01)

(52) U.S. Cl.
CPC ..... *E04H 4/108* (2013.01)

(58) Field of Classification Search
CPC ..... E04H 4/108; E04H 1/1244; E04H 1/1277; E04H 1/1266; E04H 1/1272; E04H 15/42; E04H 15/425; E04H 15/44; E04H 15/46; E04H 15/40; E04H 15/405
USPC ..... 220/9.2, 9.4; 135/126, 125
See application file for complete search history.

(56) References Cited

U.S. PATENT DOCUMENTS 379,274 A * 3/1888 Hamilton ..... E04H 15/48 135/135
2,000,644 A * 5/1935 Powers ..... E04H 15/26 135/99
3,039,478 A * 6/1962 Timmons ..... E04H 15/001 135/137
3,625,235 A * 12/1971 Gorgichuk ..... E04H 15/26 135/87
3,683,427 A 8/1972 Burkholz et al.
3,766,573 A 10/1973 Burkholz et al.
4,092,809 A 6/1978 Bellas et al.
RE30,774 E * 10/1981 Dahlbeck ..... E04H 4/108 4/498
4,901,484 A 2/1990 Santosuosso
5,617,681 A * 4/1997 Lyons ..... E04H 3/16 135/124
6,079,059 A 6/2000 Girerd
6,487,734 B1 * 12/2002 First ..... E04H 4/108 4/498
8,899,251 B2 * 12/2014 Leung ..... E04H 15/40 135/96
10,161,157 B2 * 12/2018 Grahn ..... E04H 15/54
2003/0046755 A1 * 3/2003 Hingle ..... E04H 15/44 4/498

(Continued)

FOREIGN PATENT DOCUMENTS

DE 2750083 A1 * 5/1979 ..... E04H 4/108

*Primary Examiner* — Erin Deery
(74) *Attorney, Agent, or Firm* — Downs Rachlin Martin PLLC

(57) ABSTRACT

A dome shaped roof structure for outdoor pools, both above ground pools and with minimal modification inground pools, that does not interfere with the use of the pool consisting of a plurality of flexibility poles supported by the pool, with a flexible tension ring holding the pole ends together over the center of the pool and a net fabric material that covers the pole and tension ring frame which is secured around the top of the pool. The roof structure works for all shapes and many sizes of pools providing protection from bugs and debris while still maintaining the outdoor experience. The high flexibility of the frame and tension ring allows winds and rain to flow thru without damage to the roof during inclement weather. The low number of elements that make up the roof structure make it inexpensive as well as easy to assemble, dismantle and store.

19 Claims, 10 Drawing Sheets

(56) References Cited

U.S. PATENT DOCUMENTS

2005/0072055 A1* 4/2005 Martin ..... E04H 4/108
52/3
2007/0199142 A1* 8/2007 Gray ..... E04H 4/08
4/498

* cited by examiner

FLEXIBLE NET DOME FOR OUTDOOR POOLS

FIELD OF THE DISCLOSURE

The present disclosure generally relates to the field of pool coverings. In particular, the present disclosure is directed to flexible net domes for outdoor pools and methods of installing and using the same.

BACKGROUND

Use and enjoyment of outdoor pools can be impacted by bugs and debris. Some existing pool covers provide a level of protection while allowing a user to enjoy the pool, however, existing pool covers typically contain a large number of frame members and connections making them difficult to assemble and disassemble, have too many structural components thereby reducing the feeling of an outdoor experience, are heavy, perform poorly when subjected to heavy wind loads, are not easily adaptable to differently shaped pools, are often overly complex and/or are prohibitively expensive.

SUMMARY OF THE DISCLOSURE

In one implementation, the present disclosure is directed to a pool cover which includes a frame that includes a plurality of poles each having first and second ends and a pole connection member, and a net fabric disposed on the frame; wherein the first end of each of the poles is coupled to the pool and the second end of each of the poles is located above the pool and coupled to the pole connection member, wherein the frame extends above the pool and defines an interior space between the frame and a surface of water in the pool to thereby allow use of the pool while the pool cover is installed on the pool.

In another implementation, the present disclosure is directed to a pool cover kit The Kit includes a frame that includes a plurality of poles each having first and second ends and a pole connection member; and a net fabric configured to be disposed on the frame; wherein the first end of each of the poles are configured to be coupled to a pool and the second end of each of the poles are configured to be located above the pool and coupled to the pole connection member, wherein the frame is configured to extend above the pool and define an interior space between the frame and a surface of water in the pool to thereby allow use of the pool while the pool cover is installed on the pool.

In yet another implementation, the present disclosure is directed to a method of installing a pool cover that includes a net fabric and a frame that includes a plurality of poles and a pole connection member The method includes coupling a first end of each pole to a pool; and performing a coupling and bending process that includes coupling a second end of each of the poles to the pole connection member and bending the poles to thereby form a frame that extends above the pool.

BRIEF DESCRIPTION OF THE DRAWINGS

For the purpose of illustrating the disclosure, the drawings show aspects of one or more embodiments of the disclosure. However, it should be understood that the present disclosure is not limited to the precise arrangements and instrumentalities shown in the drawings, wherein:

FIG. 1 is a detail illustration of the connection of an edge of the net fabric of the pool cover of FIG. 10 to an upper horizontal brace pole of a frame of the pool cover;

DETAILED DESCRIPTION

Figure 1:
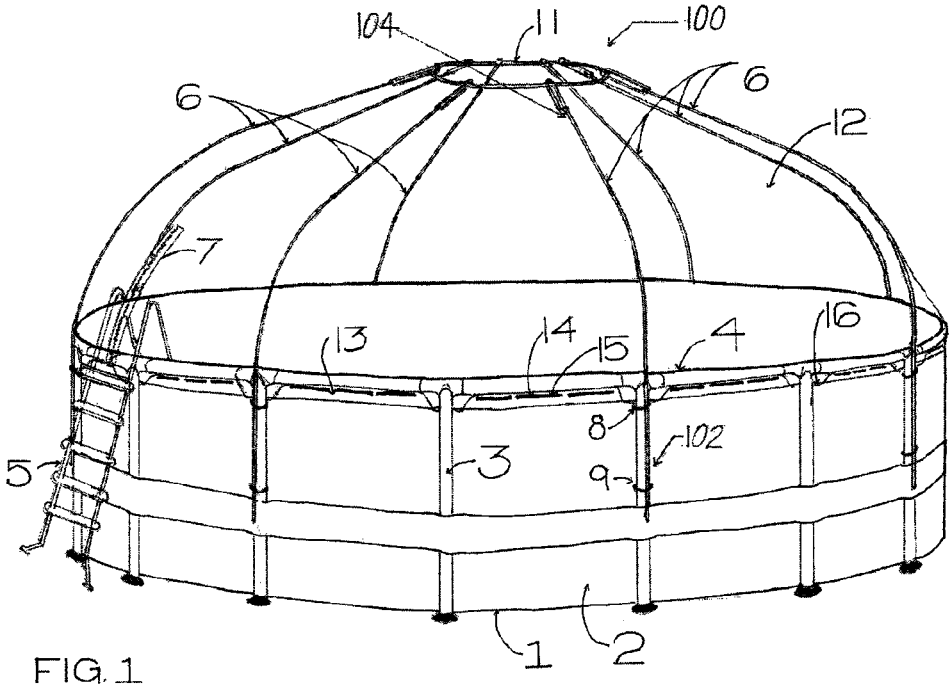
FIG. 1 is a perspective view of an example pool cover for outdoor pools on an above ground circular pool.

Aspects of the present disclosure include inexpensive roofs for pools that allows the user to enjoy the outdoor pool experience, with the surrounding views, sun, and wind breezes, without getting bit by bugs or having to spend time removing debris from the pool water. Some examples include an attractive roof cover for pools that can be installed by the owner with minimum effort, left on as long as the pool is in place, even during wind and rain storms, and dismantled and stored with minimum effort. Some examples include coverings configured to adapt to a variety of pool shapes and sizes and the ability to use the roof structure on more than just one pool size and shape with minimum or no modifications.

Some examples include a flexible, lightweight, inexpensive structural frame covered by a net fabric that forms an attractive dome shaped roof for an outdoor pool that does not interfere with the use of the pool. Some examples include coverings that allow the user to fully enjoy the outdoor experience of the pool with its sun, views and wind breezes, without getting bit by bugs or having to remove debris from the pool. In some examples the covering can be easily assembled and dismantled by one person and can be kept on the pool during inclement weather without it being damaged. Some examples include a pool cover kit that includes a frame that includes a plurality of poles and a pole connection member, and a net fabric configured to be disposed on the frame, where the pool cover kit can be easily assembled and installed and easily dissembled for storage.

Some examples include a structural frame that consists of a plurality of flexible elongate members, such as poles, and a tension ring for connecting the poles and forming a frame that provides a support for a covering such as a net fabric. In some examples the frame includes poles made of a flexible plastic pipe, for example a schedule 40 PVC 1120 pipe. In other examples, other tubing, piping, or solid rod may be used having a strength and flexibility selected for a particular application. In some examples a frame includes ½" diameter poles and in some examples may also include the same or different sized, e.g., larger diameter poles, such as ¾" diameter pipe, for use as horizontal frame members for laterally bracing vertical frame members, for example, in a implementations designed for inground pools. In some examples a frame may include telescoping frame members and formed from a plurality of elongate members of varying diameter as needed to form a telescoping assembly. Diameter and wall thickness for frame members made from materials other than PVC material may be selected according to the strength and flexibility of the material and the requirements of a particular application.

In some examples, a frame includes a tension ring that is made of a synthetic rope. In some examples, a frame includes a tension ring that is formed from an assembly that includes a synthetic rope and a flexible plastic ring having a configuration and construction similar to a hula hoop. In some examples, a frame includes a plurality of poles connected over the center of a pool by the tension ring, the poles each forming an arc shape and radiating out from the center to the pool perimeter, ends of the poles being held in place vertically to designated vertical pool frame members for above ground pools and to the pool wall for inground pools. In some examples a frame for inground pools includes additional poles along the pool walls that laterally brace the vertical poles connected to the tension ring.

In some examples, coverings made in accordance with the present disclosure are designed and configured to have a large amount of elastic behavior and resiliently flex and deform in response to static or dynamic loading such as loading from wind. As dynamic loads are imparted on the net material and structural frame the individual poles are designed and configured to move in a similar manner to a flag flapping in the wind, thereby releasing much of the dynamic loading rather than resisting the loading. Due to the pole and tension ring flexibility, and the pole movement having limits created by the tension rings connection to the other poles, even under relatively high winds, the structural frame returns back to its original position once the loads are removed without permanent damage to the roof structure.

The ability to release rather than resist dynamic loads allows for a frame construction that includes elements that can be lighter and fewer in number than prior art pool roofs that are designed to resist dynamic loads. For example, in one implementation, the number of poles of the structural frame on an eighteen foot diameter above ground pool is less than 10 and in some cases, approximately eight. With such a small number of framing members not only is the covering easy to install and dismantle but visual interference from the frame is minimized allowing for maximum sun and views and providing a more enjoyable experience of being outside in an outdoor pool while still being protected from bugs and debris. The simple design also results in a product that is inexpensive to produce.

Covers made in accordance with the present disclosure can be applied to all pool shapes and sizes and resulting in an attractive roof for the pool having the shape of either a dome, an elongated dome, or a combination of elongated domes. In some examples, a cover for a circular or square pool may consist of a structural frame made up of poles equally spaced around the pool connected to a tension ring at the top of the roof located over the center of the pool with a resulting roof shape of a single dome. In some examples, for a rectangular shaped pool there may be two tension rings, one centered over each half of the pool with poles radiating out from each tension ring. The net fabric can run smoothly between these two sections resulting in an elongated dome shape roof. Alternate pool shapes may have additional tension rings as required with the net fabric running between them.

In some examples, one cover may be designed and configured to be used on different size pools and different shaped pools. In one example, a net dome structure is designed and figured to be installed on a range of differently sized pools, for example, an above ground pool having a diameter between 10 feet and 20 feet. In one example, the same net dome may be installed on either an 18 foot diameter pool or a 14 foot diameter pool. In some examples, a height of the resulting dome when installed is inversely related to a diameter of the pool with the height of the dome being lower for larger diameter pools. A frame may also be configured to be adjustable for different sized pools by adjusting the tension ring system, for example, by reducing a diameter of the tension ring and/or reducing a length of connection members connecting the vertical poles to the tension ring. Any extra fabric in the dome when installing on a smaller pool may be trimmed or gathered and secured, for example, at the base or top of the dome. A net dome may be adaptable to a round or rectangular pool by providing vertical poles as independent members that can be selectively located at vertical frame members of the round or rectangular pool.

In some examples, a net fabric covering the structural frame may be made of a synthetic fabric that is widely sold as mosquito netting. Any net density may be used ranging from approximately 280 openings per square inch up to 8000 openings per square inch. The wind and rain can penetrate easily through a range of net densities without negatively impacting the flexibility and resilience of the structure. Nets with lower opening density and larger openings allow more breeze and sun and a relatively large opening can still keep out mosquitos, whereas nets with higher opening density and smaller openings block more wind but provide more shade and protection from biting insects smaller than mosquitos.

Turning now to the drawings, the present disclosure includes illustrated examples of flexible net coverings to demonstrate the use of flexible net domes for circular above ground pools, noncircular above ground pools and inground pools. FIG. 1 illustrates one example implementation of a pool cover 100 on a circular above ground pool 1. Pool 1 includes a pool lining 2 supported by a frame, the frame including a plurality of vertical frame members 3 and a top horizontal frame portion 4 that defines a top perimeter of the pool As shown, pool cover 100 extends above the pool and defines an interior space between the pool cover and a surface of water in the pool to thereby allow use of the pool while the pool cover is installed on the pool.

Figure 15:
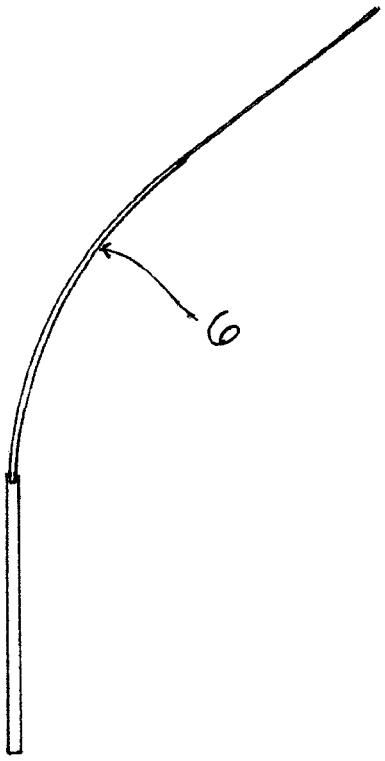
FIG. 15 illustrates an alternate example of a flexible pole for use in a pool cover frame, the pole including multiple telescoping sections.
Figure 16:
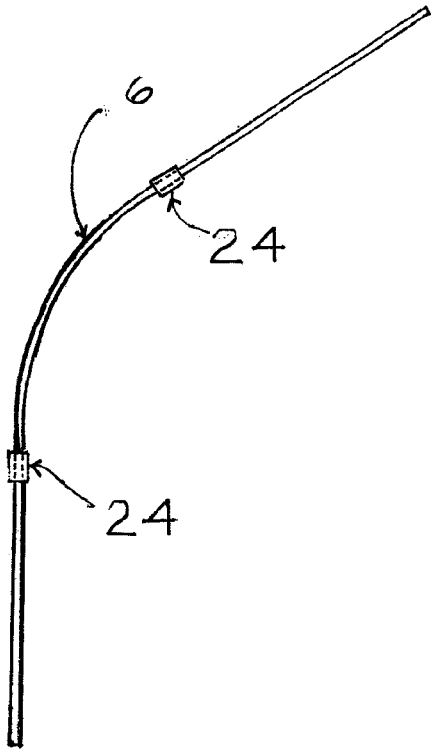
FIG. 16 illustrates an alternate example of a flexible pole for use in a pool cover frame, the pole including segments connected with couplers to thereby allow the pole to be disassembled into the segments for case of storage and shipping.

Pool cover 100 includes a frame formed from a plurality of flexible poles 6 and a pole connection member 11, each of the poles having a first end 102 (only one labeled)

connected to the pool frame and a second end 104 (only one labeled) connected to the tension ring. In the illustrated example, each of the poles 6 are selectively connected to alternate vertical pool frame members 3. Second ends 104 of poles 6 are connected to the pole connection member 11. The poles 6 and pole connection member 11 make up a structural frame. In the illustrated example, poles 6 are flexible and straight when not connected to the structural frame and configured to be resiliently bent into a curved shape to form a portion of the frame. Thus, the poles 6 are straight when disconnected from the pole connection member 11 and resiliently bent in an arc shape when coupled to the pool and the pole connection member, thereby applying a tension force and a vertical force on the pole connection member when coupled thereto. In other examples, one or more of poles 6 may have a predefined bent shape and may be rigid or flexible. Pool cover 100 also includes a net fabric 12 disposed on the structural frame and the horizontal pool frame 4 for preventing insects and debris from entering the pool. The poles 6 shown in FIG. 1 are one single piece. Each of the poles 6 can also be made up of a plurality of sections connected by couplers 24 as shown in FIG. 16, or a series of sections that telescope as shown in FIG. 15.

Figure 9:
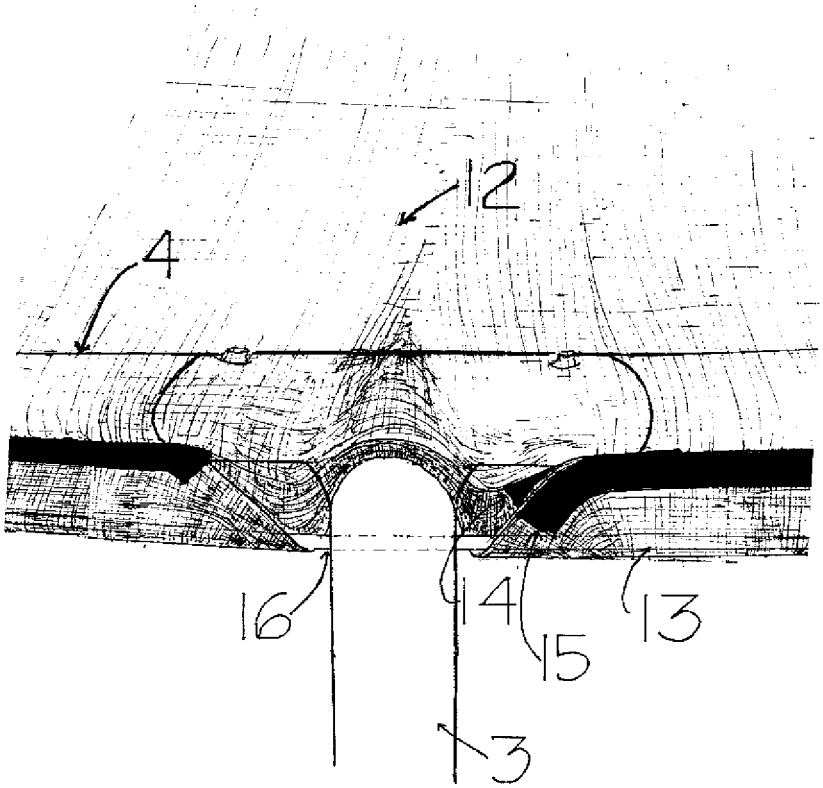
FIG. 9 is a detail illustration of the connection of an edge of the net fabric of the pool cover of FIG. 1 secured by the resilient horizontal member of FIG. 8.

Referring to FIGS. 1 and 9, in the illustrated example, net fabric 12 includes a fabric reinforced edge 13 that is held in place against the pool lining 2 below horizontal pool frame portion 4 by wrapping the edge 13 around a horizontal member 16 and securing the edge of the netting to itself, for example with Velcro® strips 14 and 15. In the illustrated example horizontal member 16 is an elastic cord In other examples, a bottom portion of net 12 may be secured to the frame or pool in any of a variety of ways, including snaps, Velcro® or other bug netting securing mechanisms known in the art, such as a spline and channel system.

Figure 4:
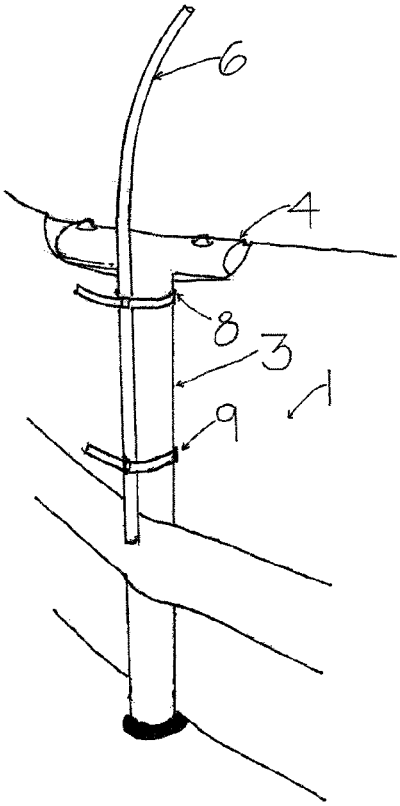
FIG. 4 is a detail illustration of a connection of a pole of the structural frame of the pool cover of FIG. 1.
Figure 5:
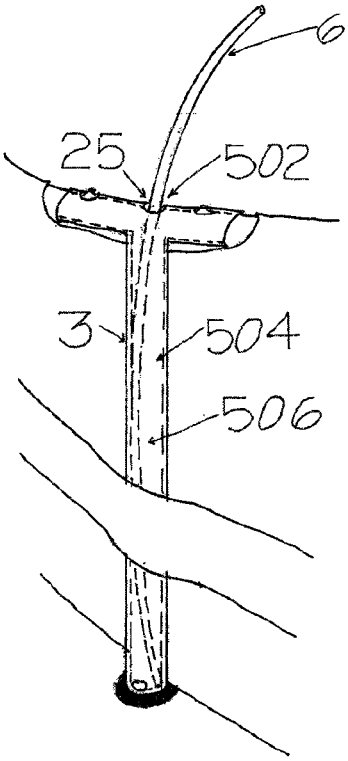
FIG. 5 is a detail illustration of an alternate implementation showing an alternate connection of a pole of a pool cover to a pool frame.

FIGS. 1 and 4 show one example approach for removably securing poles 6 to the vertical pool frame members 3 using a first strap 8 and a second strap 9, where straps 8 and 9 may have any of a variety of constructions, such as a zip tie, hose clamp, ratchet strap, or cam and buckle strap, etc. In other examples, pole 6 may be removably secured using any fastening mechanism or means known in the art, including screws or bolts. FIG. 5 illustrates another example implementation where first ends 102 of poles 6 are secured to the vertical frame members 3 by passing each pole through a corresponding opening 25 located in the horizontal pool frame portion 4 adjacent an inner cavity of one of the vertical frame members 3. In one example, a method of installing pool cover 100 includes forming a plurality of openings 25 in a top surface 502 of the horizontal portion 4 of the pool frame, the pool frame including a plurality of vertical frame members 3 that each have an inner wall 504 that defines an elongate longitudinal cavity 506 within the vertical frame member, wherein each of the openings are substantially aligned with one of the longitudinal cavities. The method further including sliding first end 102 of flexible pole 6 through the opening 25 and into the longitudinal cavity 506 to thereby secure the pole within the vertical frame member 3.

Figure 7:
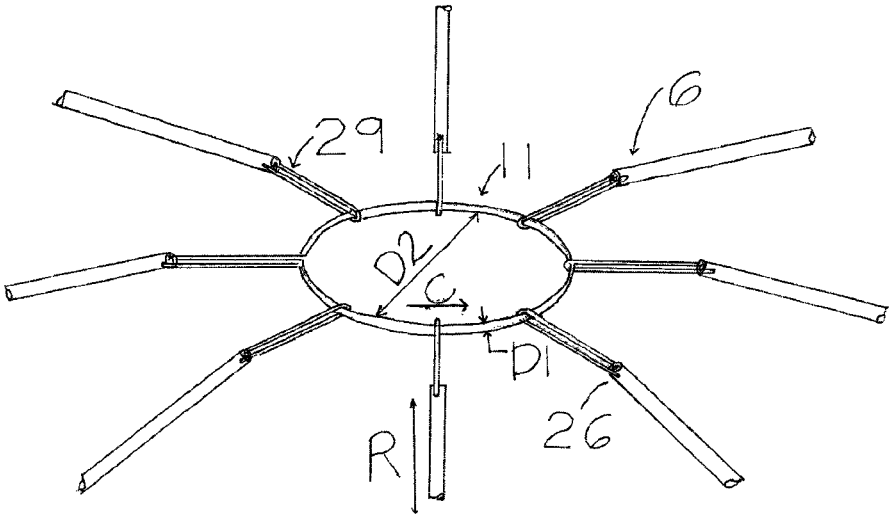
FIG. 7 is a detail illustration of the pole connection member of the pool cover of FIG. 1.
Figure 8:
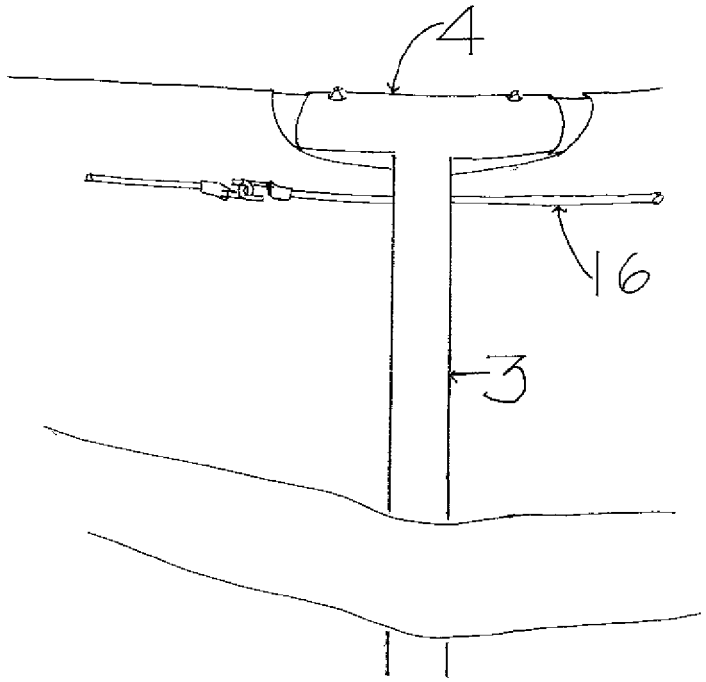
FIG. 8 is a detail illustration of a resilient horizontal member disposed around an exterior of the above ground pool of FIG. 1 for securing a bottom portion of the net fabric to the pool.

FIG. 7 is a close-up perspective view of a top portion of pool cover 100 illustrating pole connection member 11 and second ends 104 of poles 6. In the illustrated example, pole connection member 11 is an annular member that has a substantially circular cross section, where the diameter D1 of the cross section is relatively small relative to the diameter D2 of the annular member. In other examples, pole connection member 11 may have a non-circular cross-sectional shape and a diameter of the annular member may be smaller or larger relative to the diameter, width, and/or height of the cross section of the member 11 as compared to the example shown in FIG. 7. In some examples, pole connection member 11 may have a polygon shape rather than an annular shape. In the illustrated example, each of poles 6 are connected to pole connection member 11 by a corresponding coupler 29. Pole connection member 11 has a relatively rigid construction generally maintaining its annular shape while the poles 6 and couplers 29 are connected to it and in tension.

Figure 6:
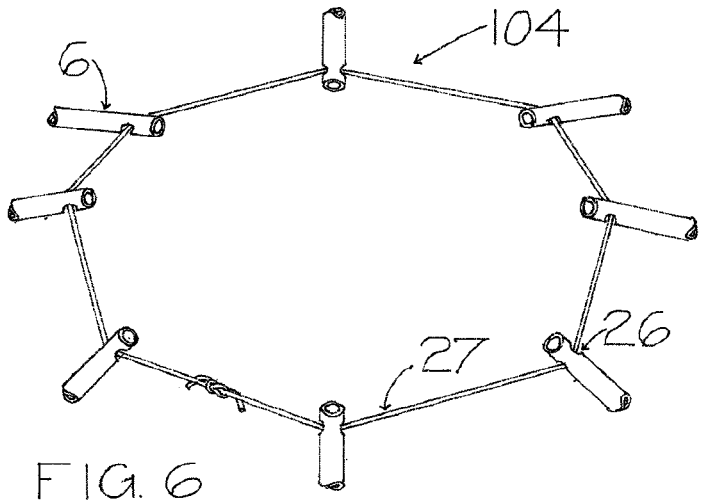
FIG. 6 is a detail illustration of one example of a pole connection member.
Figure 17:
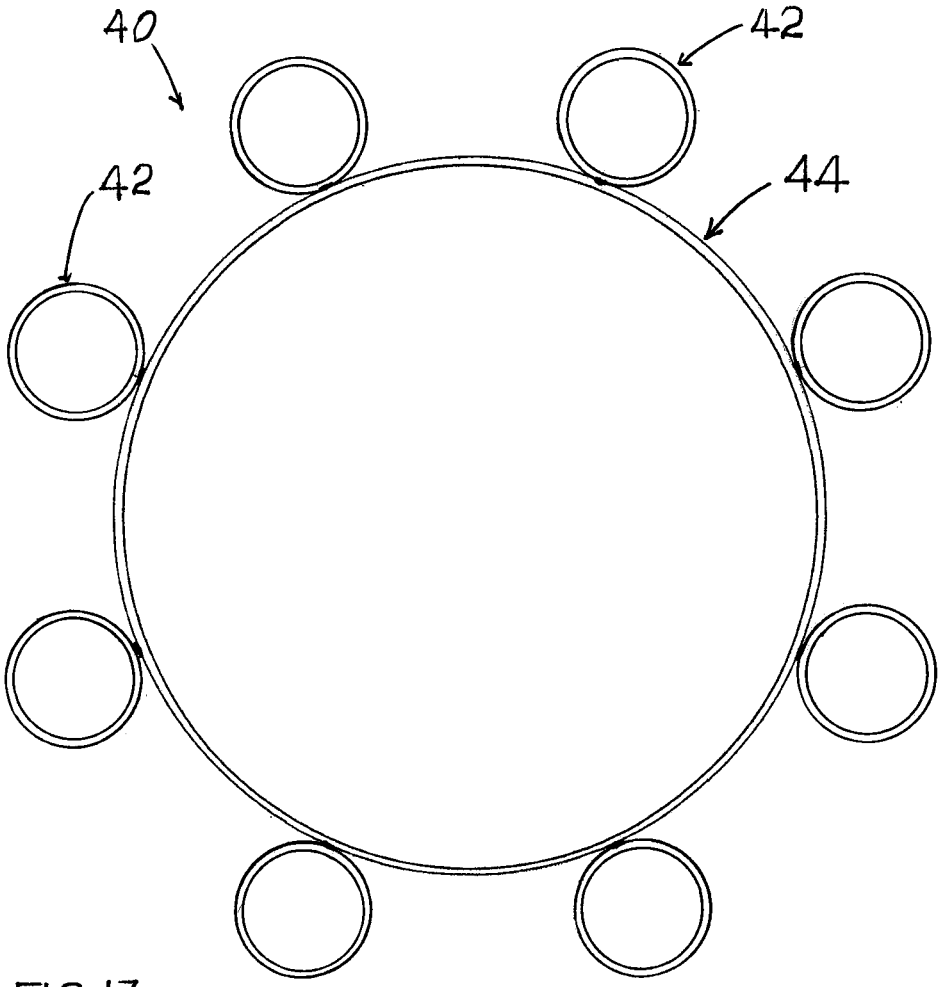
FIG. 17 illustrates a pole connection member with discrete connection points.

In the illustrated example, each of poles 6 are slidably connected to the pole connection member 11 by way of a coupler 29, where each coupler may be in the form of a loop of an elongate member, such as a loop of rope. By allowing relative circumferential movement, the assembly of the connection member 11 and poles 6 provides for a highly configurable structure, where the poles can be selectively located where needed according to a shape and size of a given pool and then connected to the pole connection member to form an assembled structure The slidable coupling also facilitates a bending and deformation of the pool cover when subjected to loads, such as wind loads by allowing a relative sliding movement between the poles and pole connection member. Pole connection member 11 is designed and configured to allow for each pole 6 to be connected at a plurality of locations along the connection member, (here a virtually infinite number of locations due to the annular shape of the connection member) which provides for flexibility during installation and allows for the same assembly to be installed a variety of differently sized and shaped pools. The couplers 29 are designed and configured to be in tension and allow relative movement between a pole 6 and the pole connection member 11 in a lateral or circumferential direction C. In the illustrated example, the diameter of each loop that forms each coupler 29 allows for a limited amount of relative axial movement in an inner or outer radial direction R and resists a radial movement beyond that limited amount. Thus, the second ends 104 of the poles 6 are removably coupled to the pole connection member 1I by coupler 29 that allows relative circumferential movement C in a direction perpendicular to a central longitudinal axis of the pole and limits relative axial movement in a direction parallel to the central longitudinal axis of the pole FIG. 6 illustrates an alternate example of a pole connection member 27 that includes a loop of an elongate member, such as a rope In the illustrated example, poles 6 are connected by threading the pole connection member 27 through apertures 26 in each pole where each aperture extends through a thickness of a corresponding pole as shown in FIG. 6. As with pole connection member 11, pole connection member 27 is designed and configured to allow relative circumferential movement of each pole 6 along the connection member which facilitates ease of installation and the adaptability of the frame structure to differently shaped and sized pools. In other examples, any of a variety of other coupling mechanisms may be used to connect poles 6 to a pole connection member. For example second ends 104 of each pole 6 may include a metal loop that a connection member may be threaded through, or a hook, or a clamp, such as a carabiner. FIG. 17, illustrates another example of a pole connection member 40 that includes a plurality of discrete connection points 42 (only some labeled) configured to connect to corresponding poles 6. In the illustrated example, rather than allowing a relative circumferential movement after coupling, such as sliding of a coupled pole 6 along a pole connection member as with pole connection member 27 or 11, pole connection member 40 includes an annular member 44 and the plurality of discrete connection points 42 coupled to the annular member for connecting to corresponding poles 6. Pole connection member 40 does not allow for a substantial relative circumferential movement after a pole has been coupled to the pole connection member. In some examples, pole connection member 40 may have more connection points 42 than a number of poles 6 to provide an increased flexibility for installation by allowing a pole to be positioned at a plurality of locations relative to the pole connection member and still be connected to the pole connection member. Annular member 44 may be made from a variety of materials, including flexible or rigid plastics and metal and may have shapes other than annular, such as any polygon shape. Connection points 42 are conceptually shown as simple circles but may also have any shape or dimension for removably coupling to corresponding poles 6. Connection points 42 are welded or otherwise fixed to member 44 and in some examples, pole connection member 40 is a unitary structure, for example a unitary member formed with an injection molding process or a metal casting process, etc.

Figure 2:
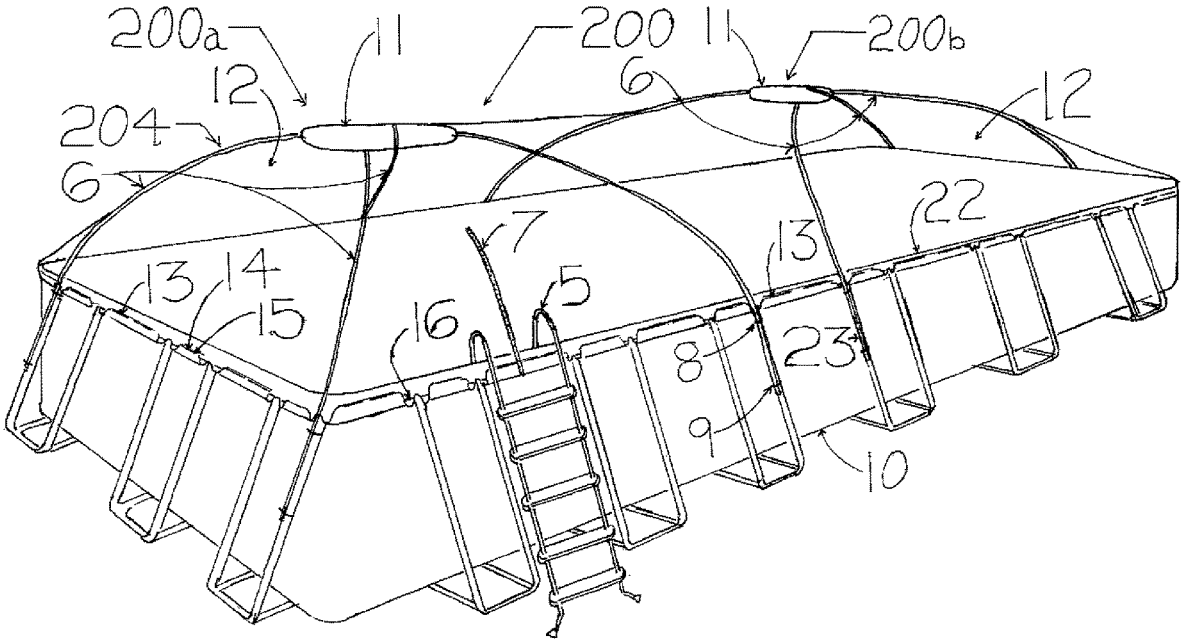
FIG. 2 is a perspective view of an example pool cover for outdoor pools on an above ground non-circular pool.
Figure 3:
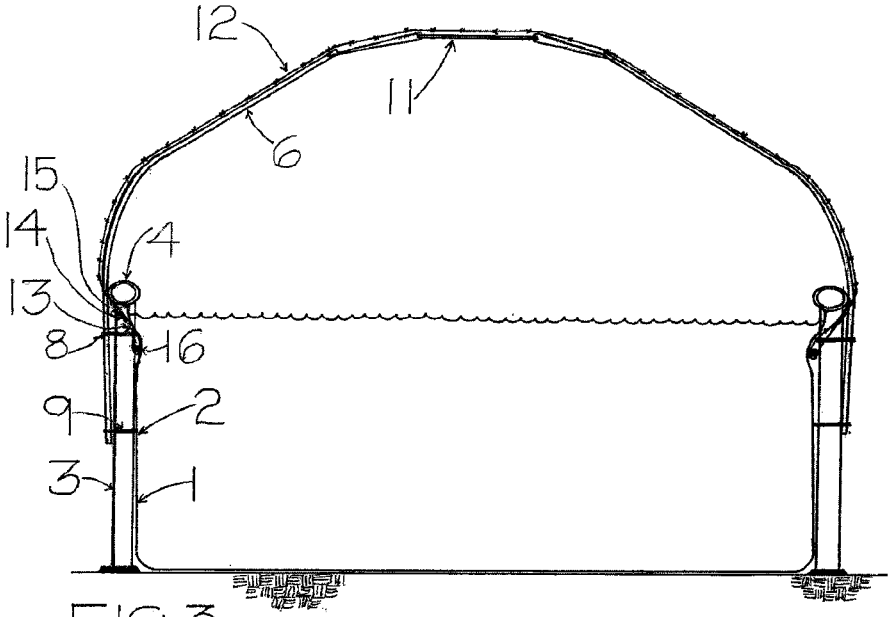
FIG. 3 is a cross-sectional view of the pool and pool cover of FIG. 1.

Reference is now made to FIG. 2, which illustrates a pool cover 200 on a noncircular above ground pool 10 in accordance with the teachings of the present disclosure. FIG. 2 shows poles 6 connected to designated vertical pool frame members 23 in the same manner as poles 6 are connected to vertical frame members 3 in FIG. 4 for circular pool 1.

In the illustrated example, pool cover 200 includes two sections 202*a* and 202*b* and half of the poles 6 are connected to one pole connection member 11 while the other half is connected to a second pole connection member 11 as shown. The poles 6 and two pole connection members 11 make up a structural frame 204. A net fabric 12 covers the structural frame 204 and reaches over and is connected to a top perimeter of pool 10 in the same manner as pool 1. The result is an attractive elongated dome shaped pool cover.

In some examples, coverings made in accordance with the present disclosure are designed and configured to be capable of assembly and installation by only one person and no special tools. For example, an assembly sequence for pool cover 100 in FIG. 1 may include first connecting the poles 6 to designated vertical pool frame members 3, for example, in the manner illustrated in FIG. 4 or 5. Next, a pole connection member, such as pole connection member 11 or pole connection member 27 can be installed. In one example, substantially straight and flexible poles 6 are used and a person can stand inside the pool 1 and holding one pole 6 can bend the pole 6 inward walking towards the center of the pool 1 until he or she reaches the end of the pole 6. The person then connects the pole connection member, such as pole connection member 11 or 27, to the end of pole 6, for example as shown in FIG. 6 or FIG. 7. When the pole connection member 27 illustrated in FIG. 6 is used the person threads the rope through the aperture 26 at the end of each pole one at a time and when all poles 6 are threaded, the person then puts the pool ladder 5 or other object in the center of the pool 1 and tightens the pole connection member until a desired curvature of the poles, diameter of the pool connection member, and/or height of the structure above the pool is achieved. The two ends of pole connection member 27 are then tied in a knot or otherwise coupled and any excess may be trimmed or tucked around pole connection member 27. When the pole connection member 11 illustrated in FIG. 7 is used the person connects each pole 6 to the pole connection member, for example, with a coupler 29 or an alternate coupling mechanism, such as a hook or clamp. This process is repeated until all poles 6 are connected to the pole connection member. After the pole connection member is connected to the poles the person then puts the net fabric 12 over the poles 6 and pole connection member and with the help of pool ladder 5 adjusts the net fabric 12 until the fabric reinforced edge 13 hangs evenly over the top perimeter of the pool 1 and the zipper 7 in the net fabric 12 is located between the poles 6 where the pool ladder 5 will be located to access the pool 1. The person then connects the fabric reinforced edge 13 to the top of the pool 1 per FIG. 9. If the net fabric 12 is larger in size than the resulting dome shaped roof the loose net fabric 12 can be gathered at the top of the dome and tied up using excess pole connection member material.

In some examples, a dismantle process may include performing the foregoing installation steps in reverse order. For example, releasing the net fabric 12 from the horizontal member 16 and removing the net fabric 12 from the poles 6 and pole connection member 11, undoing pole connection member 11, and finally removing the poles 6 from the pool vertical support frames 3 by, if straps 8 and 9 are used, either cutting or undoing the straps 8 and 9.

Figure 10:
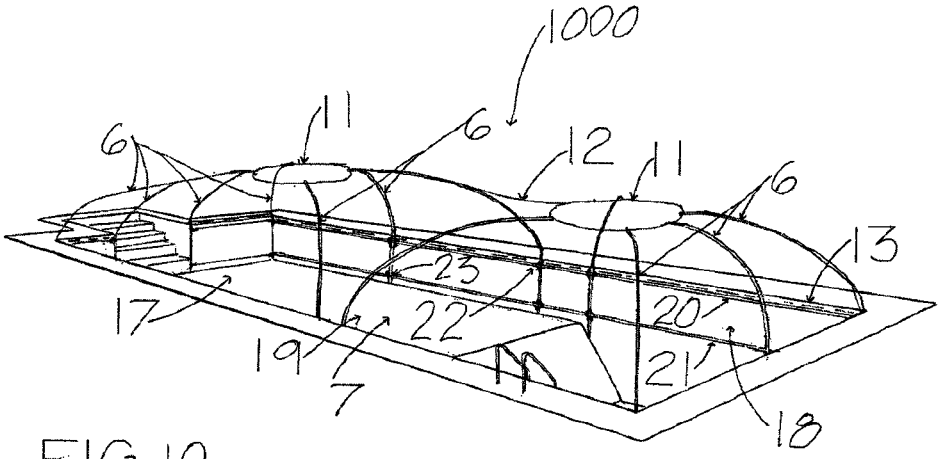
FIG. 10 is a perspective illustration of an example pool cover for outdoor pools installed on an inground pool.

FIG. 10 Illustrates a pool cover 1000 installed on an inground pool 17 in accordance with the teachings of the present disclosure. In the illustrated example, the primary difference between the pool cover 1000 for inground pool 17 and pool covers 100 (FIG. 1) and 200 (FIG. 2) is the connection of the poles 6 and net fabric 12 to the pool 17. The lower portion of poles 6 are at designated underwater locations inside the pool along the pool wall 18 starting at the elevation of the pool bottom 19 and extend vertically up the pool wall 18 and ending at a pole connection member 11.

Figure 11:
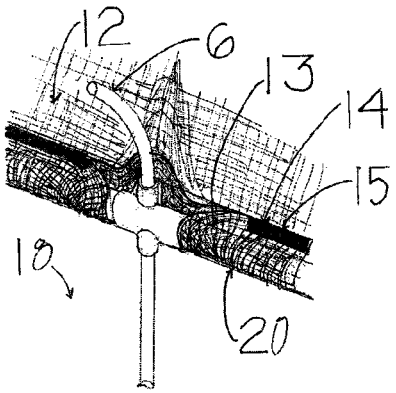
Figure 12:
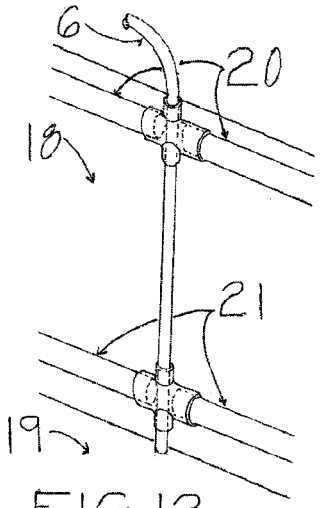
FIGS. 12, 13 and 14 are detail illustrations of horizontal brace poles of a frame of the pool cover of FIG. 10.
Figure 13:
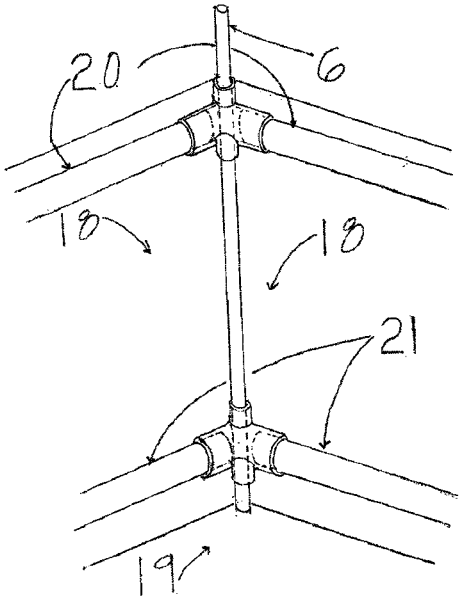
Figure 14:
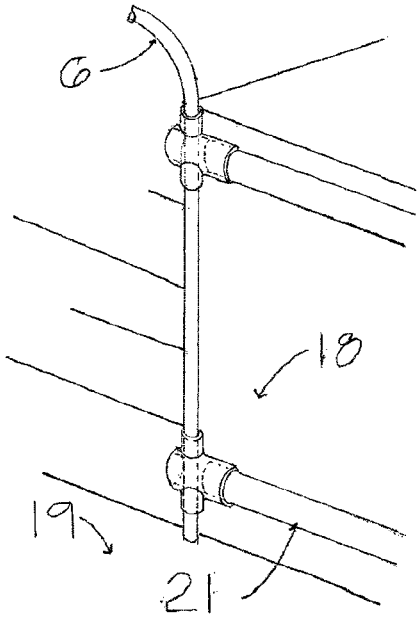

As indicated in FIGS. 11,12, and 13, the poles 6 are held in place laterally in line with the pool wall 18 with two lines of horizontal brace poles 20 and 21. Horizontal brace poles 20 are located close to the top of the pool and horizontal brace poles 21 are located at the level close to the bottom of the shallow end of the pool 17. Poles 6 are prevented from moving toward the center of the pool 17 by the horizontal force the pool wall 18 puts on the pole 6 in reaction to the force put on the pole 6 from the pole connection members 11. FIG. 11 is a detail of the connection of the reinforced net fabric 12 to the upper horizontal brace 20. The solid fabric reinforced edge 13 is tucked under brace pole 20 and the Velcro® strips 14 and 15 on edge 13 are connected together holding the net fabric 12 in place. Access to inground pools through net fabric 12 is zipper 7 located at any ladders or stairs contained in the inground pool 17.

The foregoing has been a detailed description of illustrative embodiments of the disclosure. It is noted that in the present specification and claims appended hereto, conjunctive language such as is used in the phrases "at least one of X, Y and Z" and "one or more of X, Y, and Z," unless specifically stated or indicated otherwise, shall be taken to mean that each item in the conjunctive list can be present in any number exclusive of every other item in the list or in any number in combination with any or all other item(s) in the conjunctive list, each of which may also be present in any number. Applying this general rule, the conjunctive phrases in the foregoing examples in which the conjunctive list consists of X, Y, and Z shall each encompass: one or more of X; one or more of Y; one or more of Z; one or more of X and one or more of Y; one or more of Y and one or more of Z; one or more of X and one or more of Z; and one or more of X, one or more of Y and one or more of Z.

Various modifications and additions can be made without departing from the spirit and scope of this disclosure.

Features of each of the various embodiments described above may be combined with features of other described embodiments as appropriate in order to provide a multiplicity of feature combinations in associated new embodiments. Furthermore, while the foregoing describes a number of separate embodiments, what has been described herein is merely illustrative of the application of the principles of the present disclosure. Additionally, although particular methods herein may be illustrated and/or described as being performed in a specific order, the ordering is highly variable within ordinary skill to achieve aspects of the present disclosure. Accordingly, this description is meant to be taken only by way of example, and not to otherwise limit the scope of this disclosure.

What is claimed is:

1. A pool cover, comprising:

a frame that includes a plurality of poles each having first and second ends and a pole connection member; and a net fabric disposed on the frame;

wherein the first end of each of the poles is coupled to a pool and the second end of each of the poles is located above the pool and coupled to the pole connection member, wherein the frame extends above the pool and defines an open interior space between the frame and a surface of water in the pool that is free of any elements of the pool cover to thereby allow use of the pool while the pool cover is installed on the pool;

wherein each of the poles extends from the pool to a location adjacent the pole connection member and is resiliently bent along an entire length of the pole when it is coupled to the pool and the pole connection member, each of the resiliently bent poles applying a pulling force on the pole connection member that supports the pole connection member above the pool;

wherein the second ends of the poles are flexibly connected via the pole connection member to thereby allow each pole to independently move relative to the other poles and the pole connection member in response to static or dynamic loading;

wherein each of the poles is connected to the pole connection member by an elongate flexible tension member;

wherein each of the elongate flexible tension members is configured to allow for a distance between the second end of the pole and the pole connection member to be adjusted to thereby adjust a height of the pool cover.

2. The pool cover of claim 1, wherein each of the poles are straight when disconnected from the pole connection member and resiliently bent in an arc shape when coupled to the pool and the pole connection member, thereby applying a tension force and a vertical force on the pole connection member when coupled to the pole connection member.

3. The pool cover of claim 1, wherein the pole connection member has an annular or polygon shape.

4. The pool cover of claim 1, wherein each of the elongate flexible tension members allows relative circumferential movement in a direction perpendicular to a central longitudinal axis of the pole and limits relative axial movement in a direction parallel to the central longitudinal axis of the pole.

5. The pool cover of claim 1, wherein each of the elongate flexible tension members is configured to slide along the pole connection member when a corresponding one of the poles is connected to the pole connection member by the elongate flexible tension member.

6. The pool cover of claim 1, wherein a length of the pole connection member is adjustable to adjust a diameter of the pole connection member and the eight of the cover above the pool.

7. The pool cover of claim 1, wherein the pole connection member is designed and configured to allow for the height of the pool cover above the pool to be adjustable by adjusting a diameter of the pole connection member.

8. The pool cover of claim 1, wherein the pole connection member includes a plurality of pole connection points, each second end configured to be removably coupled to a corresponding one of the connection points.

9. The pool cover of claim 8, wherein there are a greater number of the plurality of pole connection points than a number of the plurality of poles.

10. The pool cover of claim 1, wherein the pool cover includes a plurality of the pole connection members, each of the pole connection members located above the pool and aligned with a central longitudinal axis of the pool.

11. The pool cover of claim 1, wherein the pool is an above ground pool that includes a frame that includes a plurality of vertical pool frame members, wherein the first ends of the poles are coupled to corresponding ones of the vertical pool frame members.

12. The pool cover of claim 11, wherein the vertical pool frame members each have an inner wall that defines cavity, the pool frame further including a plurality of openings, wherein the first ends of the poles are slidably disposed through corresponding ones of the openings and disposed in corresponding ones of the cavities.

13. The pool cover of claim 1, wherein the pool is an inground pool, wherein the first ends are located inside the pool under water and adjacent an inner wall of the pool.

14. The pool cover of claim 1, further comprising at least one horizontal brace pole that extends between adjacent ones of the poles.

15. The pool cover of claim 1, wherein the pole connection member includes a tension ring having an annular or polygon shape.

16. The pool cover of claim 1, wherein the net fabric is a mosquito netting.

17. The pool cover of claim 1, wherein each of the poles is constructed from a plurality of poles connected end to end or is a single unitary pole and each of the poles are either a solid rod or tubular.

18. A pool cover kit, comprising:

a frame that includes a plurality of poles each having first and second ends and a pole connection member; and a net fabric configured to be disposed on the frame;

wherein the first end of each of the poles is configured to be coupled to a pool and the second end of each of the poles is configured to be located above the pool and coupled to the pole connection member, wherein the frame is configured to extend above the pool and define an interior space between the frame and a surface of water in the pool to thereby allow use of the pool while the pool cover is installed on the pool;

wherein the second end of each of the poles is configured to be flexibly connected via the pole connection member to thereby allow each pole to independently move relative to the other poles and the pole connection member in response to static or dynamic loading;

the kit further comprising a plurality of elongate flexible tension members, wherein each of the poles is configured to be connected to the pole connection member by an elongate flexible tension member;

wherein a length of each of the plurality of elongate flexible tension members is adjustable to thereby adjust a distance between the second end of a corresponding one of the poles and the pole connection member.

19. The pool cover kit of claim 18, wherein the first end of each of the poles is configured to be positioned adjacent to and directly coupled to the pool and the poles are configured to be resiliently bent into an arc shape when connected to the pole connection member.

* * * * *